US006446735B1

(12) United States Patent
Chen

(10) Patent No.: US 6,446,735 B1
(45) Date of Patent: Sep. 10, 2002

(54) TORQUE RESTRICTING STRUCTURE OF PIN HAMMER-TYPE HAMMERING MECHANISM

(75) Inventor: Hsin-Chi Chen, Taiping (TW)

(73) Assignee: Tranmax Machinery Co., Ltd., Taiping (TW)

( * ) Notice: Subject to any disclaimer, the term of this patent is extended or adjusted under 35 U.S.C. 154(b) by 0 days.

(21) Appl. No.: 10/052,350

(22) Filed: Jan. 23, 2002

(51) Int. Cl.[7] ..... B25B 19/00
(52) U.S. Cl. ..... 173/93.5; 173/93
(58) Field of Search ..... 173/93, 93.5, 93.6, 173/178, 48, 104, 205, 93.7

(56) References Cited

U.S. PATENT DOCUMENTS 3,578,091 A * 5/1971 States ..... 173/93.5
3,734,205 A * 5/1973 Maurer ..... 173/93.5
4,313,505 A * 2/1982 Silvern ..... 173/93.5
4,767,379 A * 8/1988 Schoeps ..... 173/93.5
5,622,230 A * 4/1997 Giardino et al. ..... 173/93
5,704,434 A * 1/1998 Schoeps ..... 173/93.5
5,706,902 A * 1/1998 Eisenhardt ..... 173/93.5
6,135,212 A * 10/2000 Georgiou ..... 173/48

* cited by examiner

*Primary Examiner*—Scott A. Smith
(74) *Attorney, Agent, or Firm*—Dennison, Schultz & Dougherty

(57) ABSTRACT

Torque restricting structure of pin hammer-type hammering: mechanism, including: an anvil having a shaft body, two symmetrical arched jaws projecting from the middle of the shaft body opposite to each other; two hammering pins each having a column body parallel to the shaft body of the anvil, the hammering pins being axially movable between a hammering position and a separating position, whereby when in the hammering position, a lateral face of each hammering pin hammers a lateral face of a corresponding projecting jaw and when in the separating position, the hammering pins are separated from the projecting jaws; a locating guide section; and a cam having a ridge section for abutting against the locating guide section. When the cam and the locating guide section are moved relative to each other, the cam is pushed to drive the hammering pins to move between the hammering position and the separating position.

5 Claims, 8 Drawing Sheets

TORQUE RESTRICTING STRUCTURE OF PIN HAMMER-TYPE HAMMERING MECHANISM

BACKGROUND OF THE INVENTION

The present invention is related to a pneumatic tool, an more particularly to a torque restricting structure of pin hammer-type; hammering mechanism.

The hammering mechanisms of conventional pneumatic tools at least include two types. One is twin hammer-type hammering mechanism in which specifically shaped hammers are provided to hammer an anvil. The other is pin clutch-type hammering mechanism as disclosed in U.S. Pat. No. 3,174,597, in which dog pins are used to hammer an anvil. In the pin clutch-type hammering mechanism, a ridged rail is disposed on a cam sleeve. The ridged rail serves to guide two dog pins on two sides of the anvil to radially hammer the jaws projecting from two sides of the anvil in predetermined travel. An great external force is instantaneously applied to the anvil to make the same rotate.

This applicant recites in U.S. patent application Ser. No. 09/986,543 that in actual use, the above conventional twin hammer-type hammering mechanism will instantaneously output an excessively great torque which tends to damage a work piece. Reversely, in actual use of the pin clutch-type hammering mechanism, the anvil is instantaneously hammered by the dog pins and rotated. In the instant of hammering, the pin clutch-type hammering mechanism due to instantaneously excessively great output can be hardly controlled within a safety torque range. Therefore, the work piece is very likely to get damaged. According to the above, it is known that both of the twin hammer-type hammering mechanism and the pin clutch-type hammering mechanism have the same shortcoming and need to be improved.

SUMMARY OF THE INVENTION

It is therefore a primary object of the present invention to provide a torque restricting structure of pin hammer-type hammering mechanism. The torque restricting mechanism is able to restrict the torque output by the pneumatic tool within a safety range, whereby the pneumatic tool can stably output torque.

According to the above object, the torque restricting structure of pin hammer-type hammering mechanism of the present invention includes: an anvil having a shaft body, two symmetrical arched jaws projecting from the middle of the shaft body opposite to each other; two hammering pins each having a column body parallel to the shaft body of the anvil, the hammering pins being axially movable between a hammering position and a separating position, whereby when in the hammering position, a lateral face of each hammering pin hammers a lateral face of a corresponding projecting jaw and when in the separating position, the hammering pins are separated from the projecting jaws; a locating guide section; and a cam having a ridge section for abutting against the locating guide section. When the cam and the locating guide section are moved relative to each other, the cam is pushed to drive the hammering pins to move between the hammering position and the separating position. The ridge section has a ridge tip in a highest position. When the hammering pins are driven by the cam to move to the hammering position, the ridge face of the ridge section abuts against the locating guide section has not yet reached the position of the ridge tip, whereby the hammering pins have already abutted against the corresponding projecting jaws to restrict the cam from being further moving and the ridge section and the locating guide section are kept engaged with each other.

The present invention can be best understood through the following description and accompanying drawings wherein:

DETAILED DESCRIPTION OF THE PREFERRED EMBODIMENTS

Figure 1:
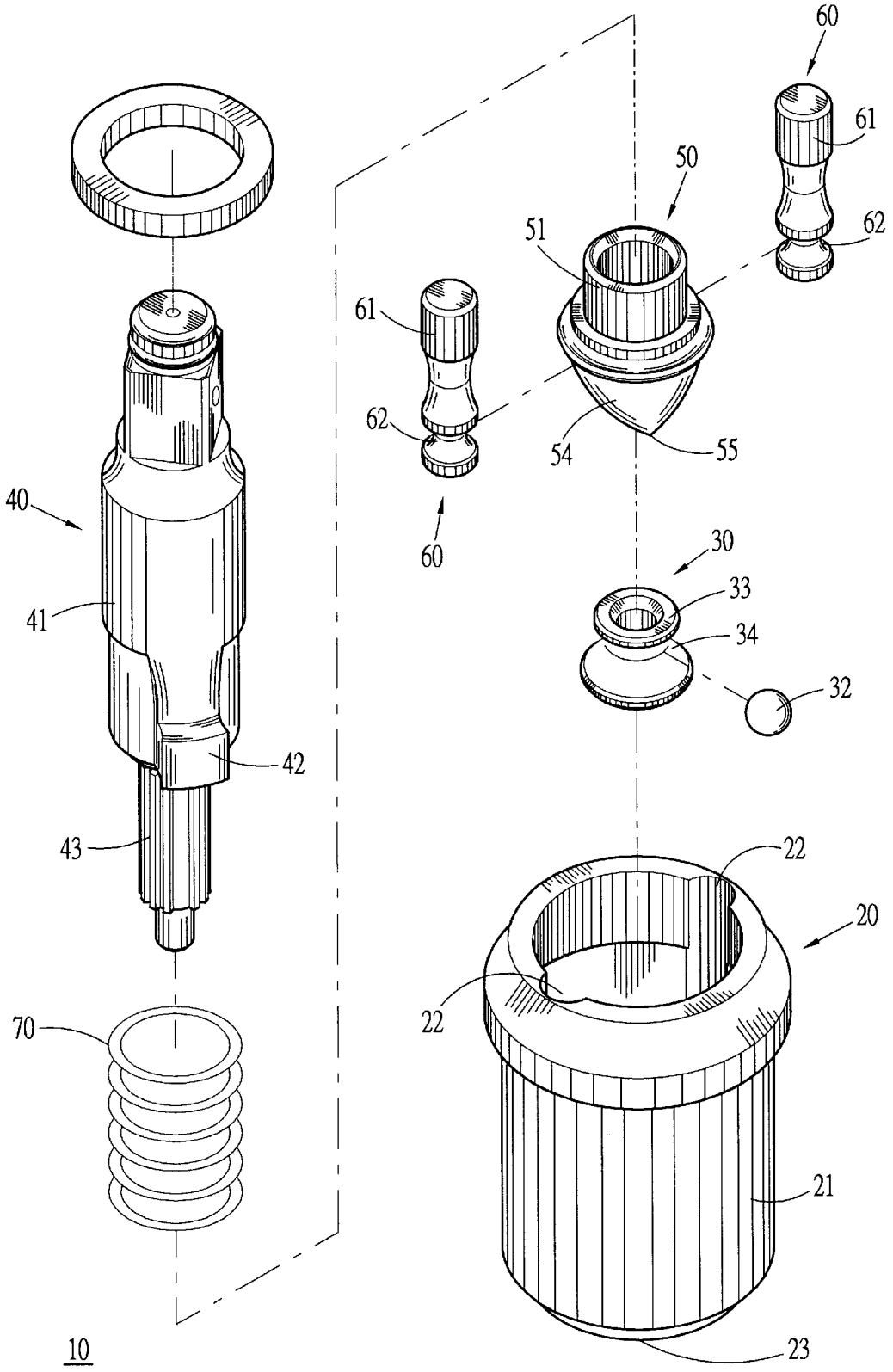
FIG. 1 is a perspective exploded view of a first embodiment of the present invention.
Figure 2:
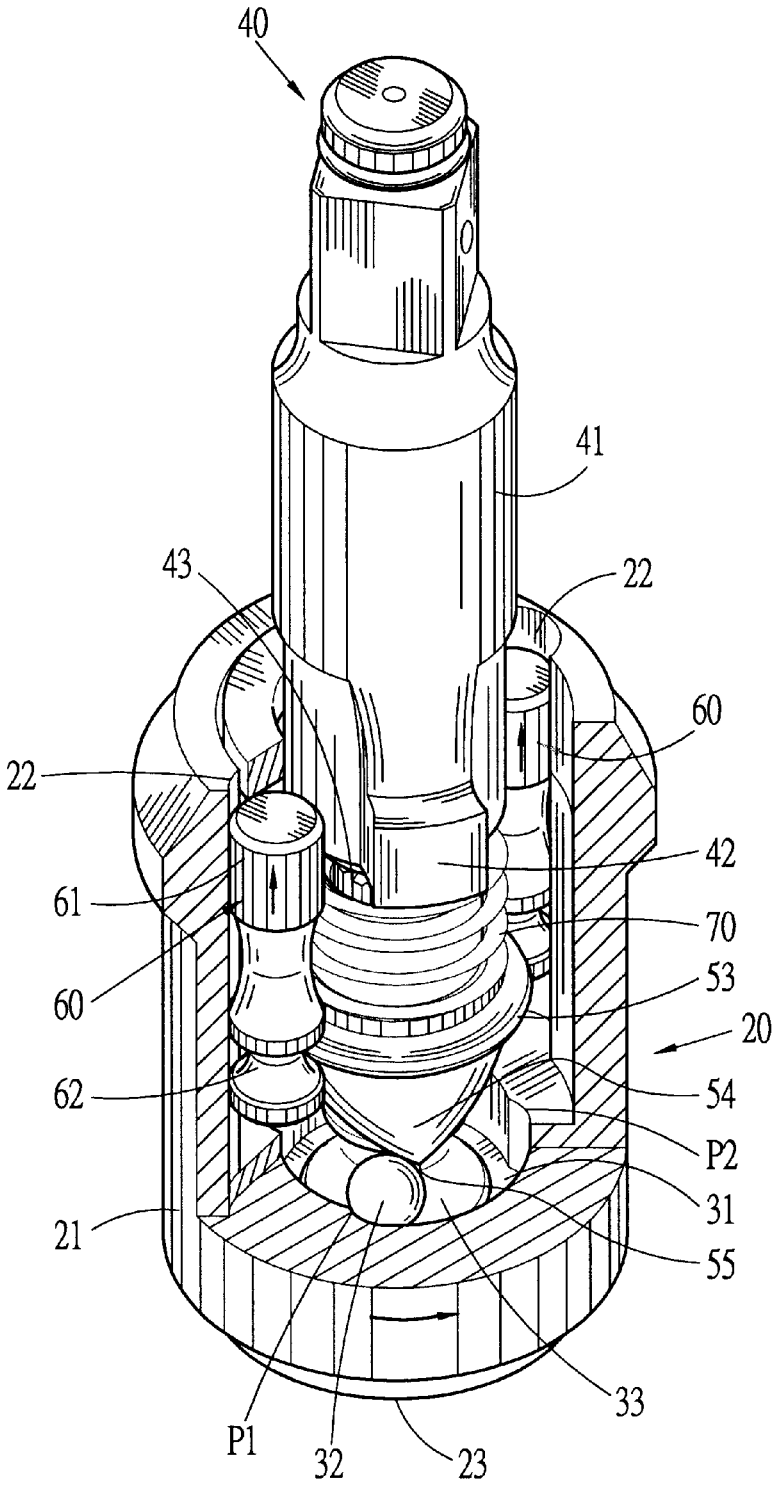
FIG. 2 is a partially sectional perspective assembled view of the first embodiment of the present invention.
Figure 4:
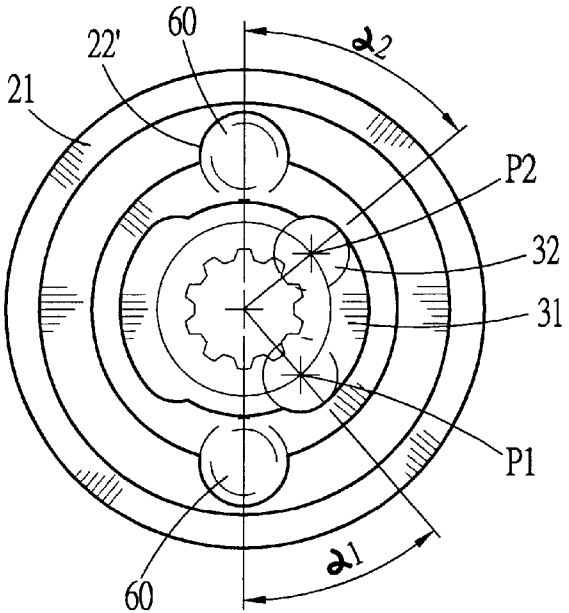
FIG. 4 is a top view of the hammer sleeve of the first embodiment of the present invention.
Figure 3:
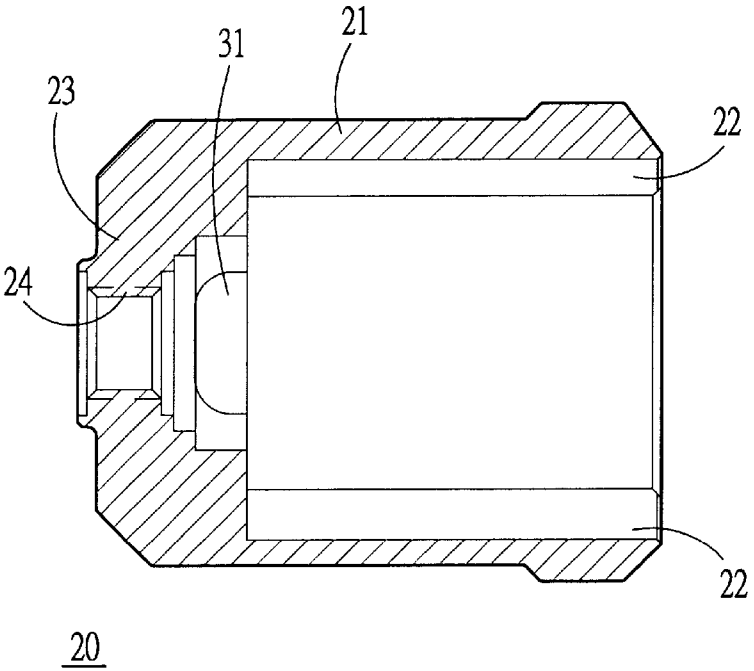
FIG. 3 is a sectional view of the hammer sleeve of the first embodiment of the present invention.

Please refer to FIGS. 1 to 4. In a first embodiment of the present invention, the torque restricting structure 10 of pin hammer-type hammering mechanism is basically identical to the conventional pin clutch-type hammering mechanism. The present invention is characterized by a locating guide section which is able to control and restrict the torque output within a certain range.

The torque restricting structure 10 of the pin hammer-type hammering mechanism includes a hammer sleeve 20, a locating guide section 30, an anvil 40, a cam 50, two hammering pins 60 and a spring 70.

The hammer sleeve 20 has a tubular body section 21 with a certain inner diameter. Two symmetrical recesses 22 are respectively formed on inner face of the wall of the body section 21 opposite to each other. The recesses 22 extend along the axis of the body section 21. An annular diaphragm-like end section 23 is coaxially fixedly disposed at one end of the body section 21. The end section 23 defines a central shaft hole. Several ribs 24 are parallelly formed on inner face of the wall of the central shaft hole of the end section 23.

The locating guide section 30 includes a guide concavity 31 formed on inner face of the end section 23. The guide concavity 31 has an arch which is smaller than 180 degrees and extends from a first position p1 to a second position p2 about the curvature center of the body section 21. About the axis of the body section 21, the first position p1 and an adjacent recess 22 contain a first angle $\alpha$1. About the axis of the body section 21, the second position p2 and an adjacent recess 22 contain a second angle $\alpha$2. The first angle $\alpha$1 is smaller than the second angle $\alpha$2. The second angle $\alpha$2 is equal to that of the prior art. A rolling bead 32 is received in the guide concavity 31 and reciprocally movable between the first and second positions p1, p2. A roller seat 33 is coaxially attached to the end section 23 for restricting the rolling bead 32 within the guide concavity 31. The circumference of the roller seat 33 is formed with an annular groove 34 for receiving the rolling bead 32.

The anvil 40 is identical to the conventional one and is coaxially fitted in the hole of the body section 21. The anvil 40 has a shaft body 41. Two arched jaws 42 project from the middle of the shaft body 41 opposite to each other. Multiple ratchet ribs 43 with a certain length are axially formed on the circumference of one end of the shaft body 41.

The cam 50 is identical to that of the prior art, having a collar 51 fitted on one end of the shaft body 41. Multiple ratchet ribs 52 are formed on inner face of the collar 51 and interlaced and engaged with the ratchet ribs 43 of the anvil 40 so as to fix the cam 50 with the anvil 40. An annular flange 53 is formed on the ci umference of one end of the collar 51. A ridge section 54 projects from one end of the collar 51. Two ridge grooves ( not shown ) are formed on two lateral faces of the ridge section 54 for abutting against the rolling bead 32. The ridge section 54 has a ridge tip in a highest position aligned with a middle point c of the arch of a corresponding projecting jaw 42.

Each hammering pin 60 has a column body 61 received in the recess 22 of the hammer sleeve 20. An annular groove 62 is formed on the column body 61, in which the annular flange 53 of the cam 50 is inlaid.

The spring 70 is fitted on the shaft body 41. Two ends of the spring 70 abut against the middle portions of the cam 50 and the shaft body 41 to provide a resilient force for pressing the cam 50 against the locating guide section 30.

According to the above arrangement, when the hammer sleeve 20 is driven by air chamber components of the pneumatic tool and rotated, the guide concavity 31 is moved along with the hammer sleeve 20. Depending on the moving direction of the hammer sleeve 20, the guide concavity 31 is moved toward the rolling bead 32 to locate the rolling bead 32 in the first or second position. Then, the located rolling bead 32 abuts against the ridge groove of the ridge section 54. By means of the height difference of the ridge section 54, the cam 50 is pushed to axially move along the anvil 40. Accordingly, the hammering pins 60 are axially moved from a separating position spaced from the projecting jaws 42 to a hammering position abutting against a lateral face of the projecting jaws 42. Therefore, the external force exerted onto the hammer sleeve 20 is transmitted to the anvil 40 to rotate the same. The anvil 40 further transmits the force from the output end to outer side.

It should be noted that when the rolling bead 32 is located in the first position p1 and the hammering pins 60 are moved to the hammering position, the hammering pins 60 are kept in the hammering position and the anvil 40, hammering pins 60, cam 50, locating guide section 30 and the hammer sleeve 20 are engaged with each other, whereby the transmission path of the force is kept associated and thus the power output from the air chamber of the pneumatic tool can be directly transmitted to the anvil 40. Accordingly, the problem of excessively great instantaneously output torque caused by the hammering operation can be avoided.

Figure 5:
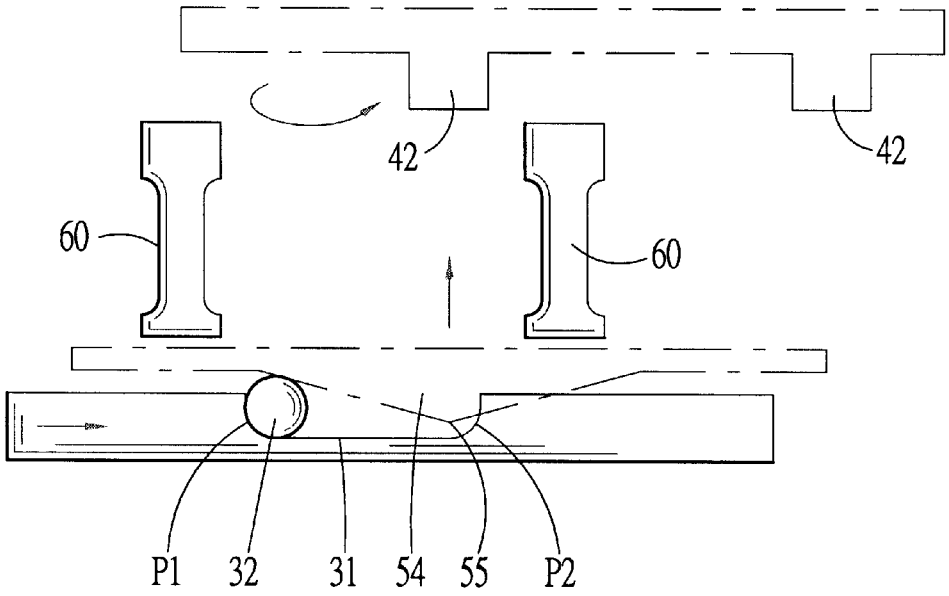
FIG. 5 is a stretched view showing the operation of the first embodiment of the present invention.
Figure 5:
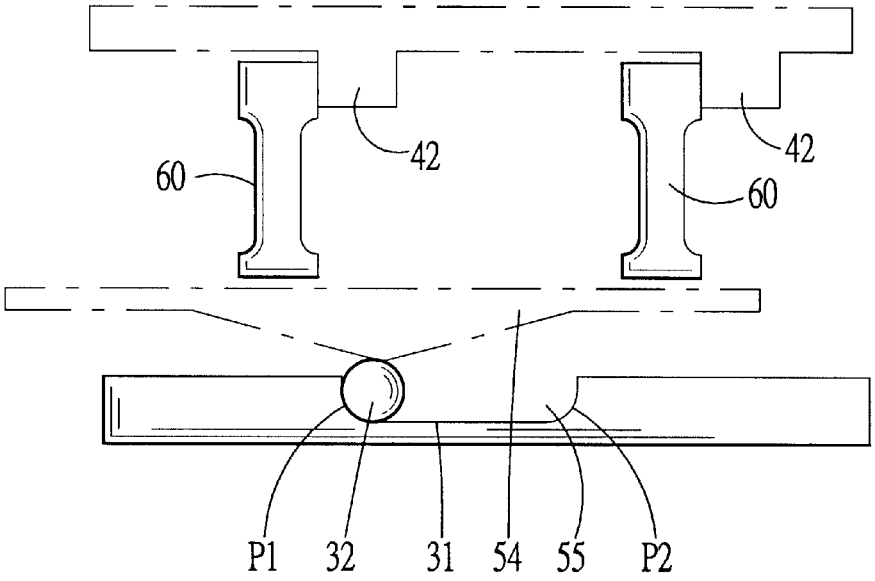
Figure 6:
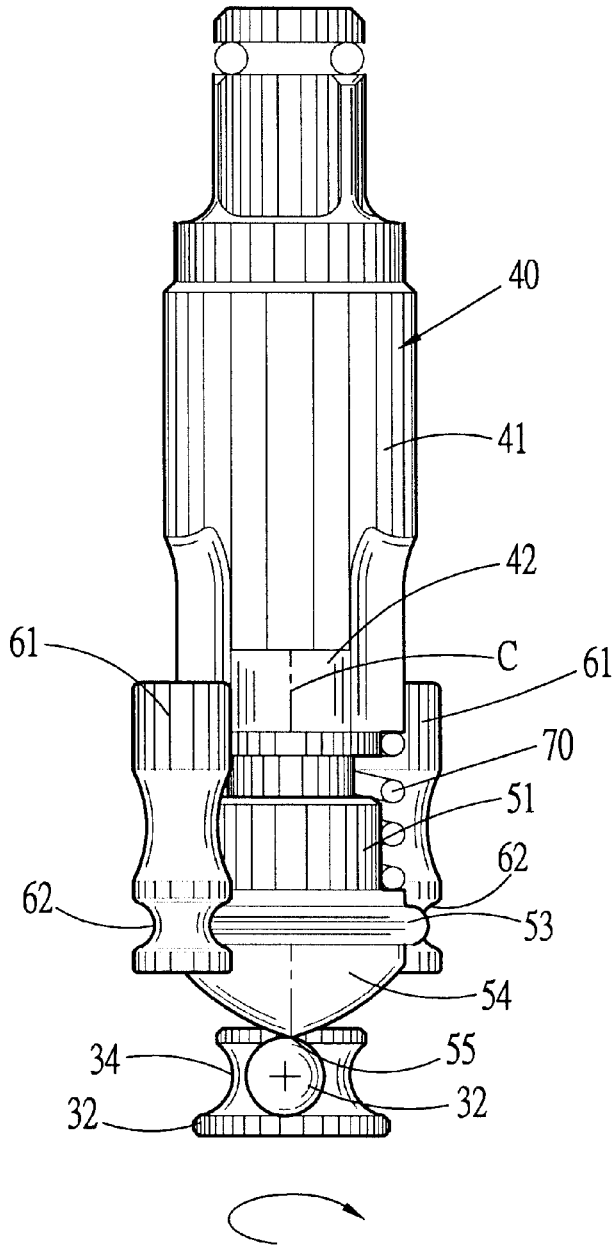
FIG. 6 is a side view of the first embodiment of the present invention, showing that the hammering pins are positioned in the hammering position.

Referring to FIGS. 5 and 6, in this embodiment, the first angle $\alpha 1$ is smaller than the second angle $\alpha 2$ for the hammering operation. In other words, from the time when the rolling bead 32 is located in the first position p1 to serve as support point for the axially moving cam 50 to the time when the cam 50 is pushed and the hammering pins 60 are moved to the hammering position to hammer the projecting jaws 42, the travel is shorter. More specifically, the travel is smaller than the length of one side of the ridge section 54. Accordingly, when the hammering pins 60 are moved to the hammering position, the ridge face of the ridge section 54 abutting against the rolling bead 32 has not yet moved to the position of the ridge tip 55. In this relatively moving state, the hammering pins 60 have already abutted against the corresponding projecting jaws 42 to reversely restrict the cam 50 from being further axially moving. In a continuously rotating state, the rolling bead 32 is forcedly kept engaged with the ridge section 54 and prevented from passing over the ridge tip 55. In the successive travel, the engagement makes the power of the air chamber directly transmitted to the anvil 40 to rotate the same.

Figure 8:
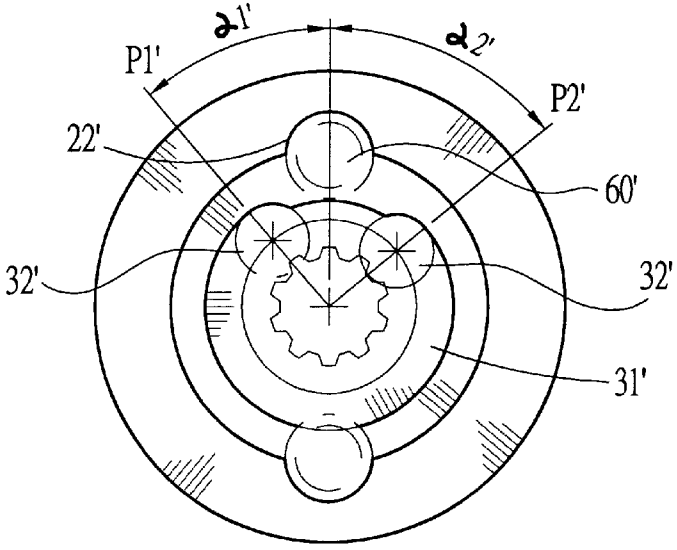
FIG. 8 is a top view of the hammer sleeve of the second embodiment of the present invention.
Figure 7:
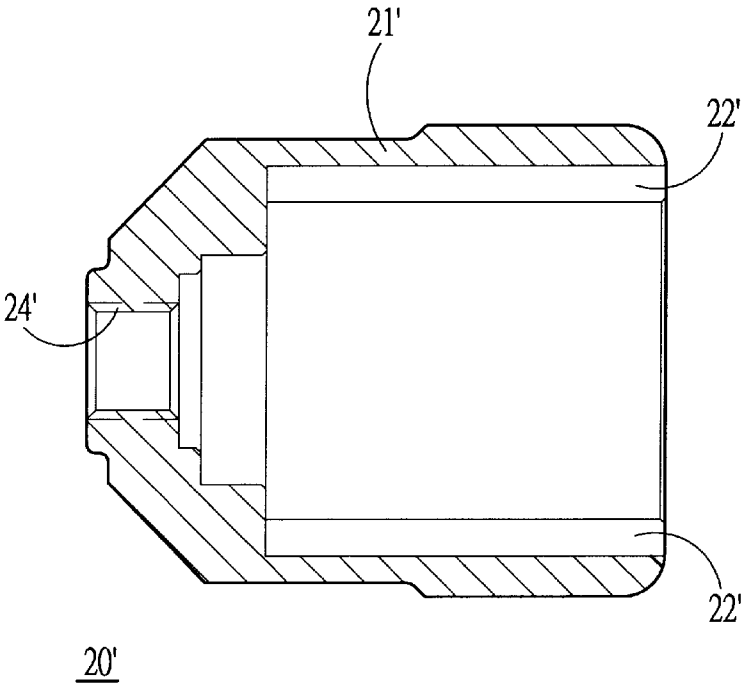
FIG. 7 is a sectional view of the hammer sleeve of a second embodiment of the present invention.

FIGS. 7 and 8 show a second embodiment of the torque restricting structure 10' of the pin hammer-type hammering mechanism of the present invention. This embodiment is substantially identical to the first embodiment. The only difference is that in the first embodiment, the length of the guide concavity is smaller than 180 degrees, serving to output little torque, while the extending length of the guide concavity 31' is larger than 180 degrees, serving to output great torque as in the conventional technique. Except this, the second embodiment achieves the same effect as the first embodiment.

Figure 9:
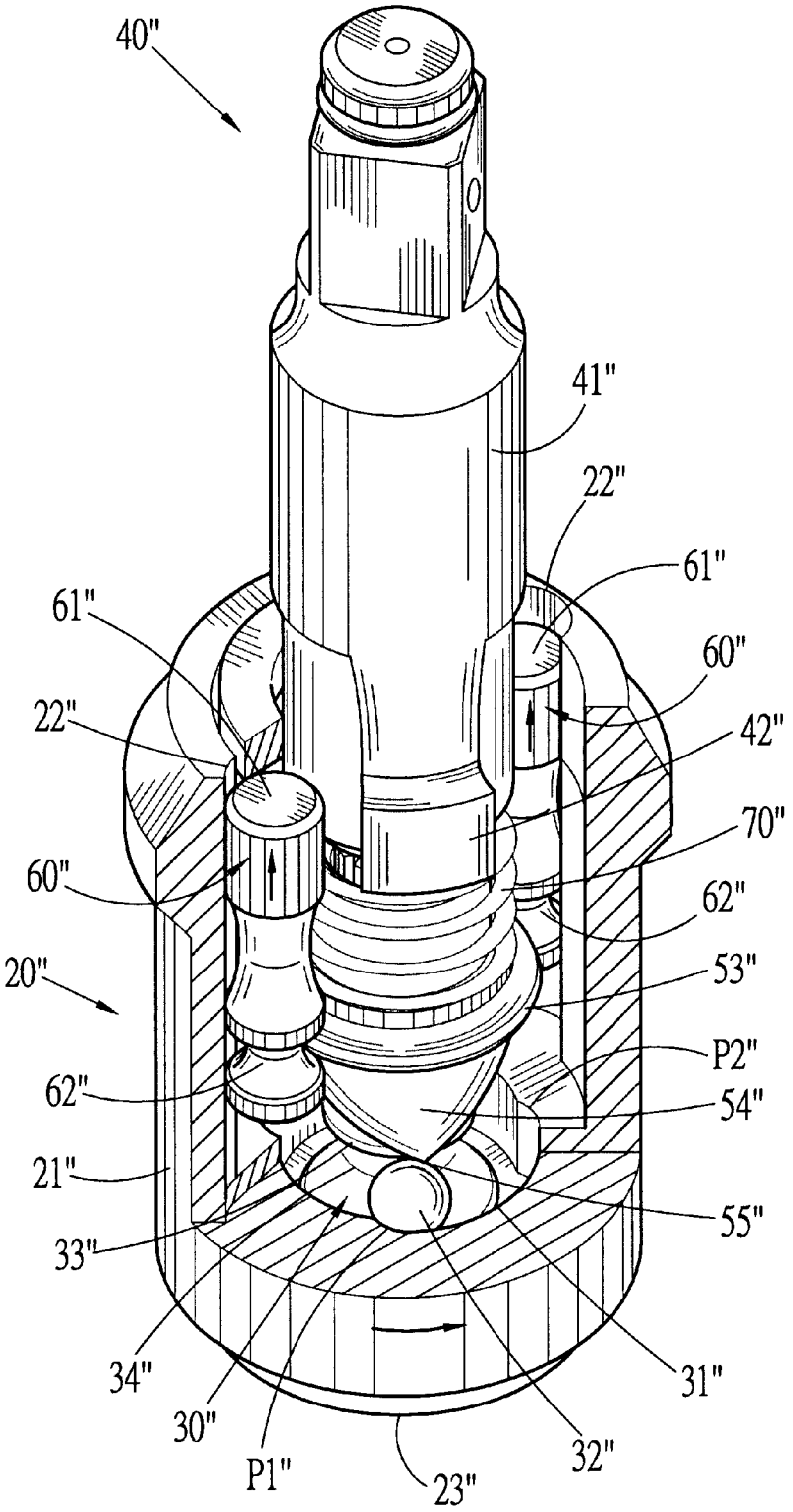
FIG. 9 is a partially sectional perspective assembled view of a third embodiment of the present invention.
Figure 10:
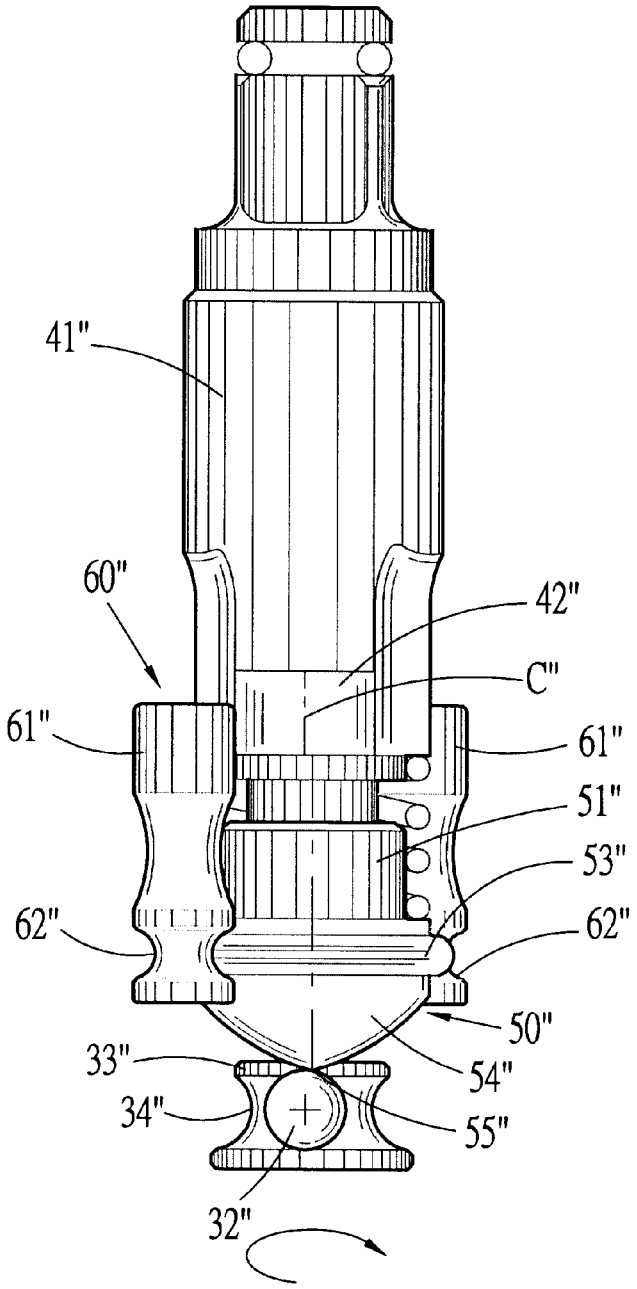
FIG. 10 is a side view of the third embodiment of the present invention, showing that the hammering pins are positioned in the hammering position.

FIGS. 9 and 10 show a third embodiment of the torque restricting structure 10" of the pin hammer-type hammering mechanism of present invention. This embodiment is basically structurally identical to the first embodiment. However, the third embodiment technically different from the first embodiment.

More specifically, from the time when the rolling bead 32" is located in the first position p1" to serve as support point for the axially moving cam 50" to the time when the cam 50" is pushed and the hammering pins 60" are moved to the hammering position to hammer the projecting jaws 42", the travel is shortened. However, it is not shortened due difference between the first and second angles. Reversely, in this embodiment, the first and second angles are equal to each other as in the prior art. Instead, the position of the ridge tip 55" is such changed as not to be aligned with the middle point c" of the arch length of the projecting jaw 42". In actual manufacturing, this can be achieved by means of only increasing the arch length of one side of the projecting jaw. Accordingly, the rolling bead 32" has not yet reached the ridge tip 55" when the side of the projecting jaw 42" abuts against the corresponding hammering pin 60". This can also achieve the effect as the above two embodiments. Accordingly, in a specific rotational direction, the output torque of the pneumatic tool can be kept within a safety range.

The above embodiments are only used to illustrate the present invention, not intended to limit the scope thereof. Many modifications of the above embodiments can be made without departing from the spirit of the present invention.

What is claimed is:

1. Torque restricting structure of pin hammer-type hammering mechanism, comprising:

an anvil having a shaft body, two symmetrical arched jaws projecting from the middle of the shaft body opposite to each other;

two hammering pins each having a column body parallel to the shaft body of the anvil, the hammering pins being axially movable between a hammering position and a separating position, whereby when in the hammering position, a lateral face of each hammering pin hammers a lateral face of a corresponding projecting jaw and when in the separating position, the hammering pins are separated from the projecting jaws;

a locating guide section; and a cam having a ridge section for abutting against the locating guide section, whereby when the cam and the locating guide section are moved relative to each other, the cam is pushed to drive the hammering pins to move between the hammering position and the separating position, the ridge section having a ridge tip in a highest position, said torque restricting structure being characterized in that when the hammering pins are driven by the cam to move to the hammering position, the ridge face of the ridge section abutting against the locating guide section has not yet reached the position of the ridge tip, whereby the hammering pins have already abutted against the corresponding projecting jaws to restrict the cam from being further moving and the ridge section and the locating guide section are kept engaged with each other.

2. Torque restricting structure of pin hammer-type hammering mechanism as claimed in claim 1, further comprising a hammer sleeve having a tubular body section, one end section being fixedly disposed at one end of the body section, two recesses being respectively formed on inner face of the wall of the body section opposite to each other for receiving the hammering pins, the locating guide section being disposed on inner face of the end section.

3. Torque restricting structure of pin hammer-type hammering mechanism as claimed in claim 1, wherein the locating guide section includes a guide concavity having a predetermined arch length extending from a first position to a second position about the curvature center of the body section, about the axis of the body section, the first position and an adjacent corresponding recess containing a first angle, about the axis of the body section, the second position and an adjacent corresponding recess containing a second angle, the first angle being smaller than the second angle, a rolling bead being received in the guide concavity.

4. Torque restricting structure of pin hammer-type hammering mechanism as claimed in claim 1, wherein the cam is axially movably fitted on the shaft body to align the ridge tip with the middle point of the arch length of a corresponding projecting jaw.

5. Torque restricting structure of pin hammer-type hammering mechanism as claimed in claim 1, wherein the cam is axially movably fitted on the shaft body to align the ridge tip with one side of the middle point of the arch length of a corresponding projecting jaw.

* * * * *